US008234827B1

(12) United States Patent
Schroeder, Sr. et al.

(10) Patent No.: US 8,234,827 B1
(45) Date of Patent: Aug. 7, 2012

(54) EXPRESS FRAMING BUILDING CONSTRUCTION SYSTEM

(76) Inventors: Robert Schroeder, Sr., Newburgh, NY (US); Harry Gittlitz, Spring Valley, NY (US); Robert Schroeder, Jr., Walden, NY (US)

( * ) Notice: Subject to any disclaimer, the term of this patent is extended or adjusted under 35 U.S.C. 154(b) by 943 days.

(21) Appl. No.: 11/469,528

(22) Filed: Sep. 1, 2006

Related U.S. Application Data

(60) Provisional application No. 60/713,455, filed on Sep. 1, 2005.

(51) Int. Cl.
*E04B 1/16* (2006.01)
*E04B 1/61* (2006.01)
*E04B 7/00* (2006.01)

(52) U.S. Cl. ..... 52/334; 52/702; 52/638

(58) Field of Classification Search ..... 52/334, 52/92.2, 266, 270, 272, 250, 289, 702, 638, 52/712, 715

See application file for complete search history.

(56) References Cited

U.S. PATENT DOCUMENTS

| | | | | | |
|---|---|---|---|---|---|
| 136,947 | A | | 3/1873 | Voeickers | |
| 526,302 | A | | 9/1894 | Drake | |
| 529,331 | A | * | 11/1894 | Lane | 403/189 |
| 1,789,827 | A | | 1/1931 | McKay | |
| 1,858,701 | A | | 5/1932 | Boettcher | |
| 2,272,910 | A | | 2/1942 | Gobberdlol | |
| 3,392,499 | A | * | 7/1968 | McManus | 52/702 |
| 3,420,560 | A | | 1/1969 | Pfahning | |
| 3,623,755 | A | * | 11/1971 | Ratliff, Jr. | 403/217 |
| 3,714,304 | A | * | 1/1973 | Carner et al. | 64/572 |
| 3,837,135 | A | * | 9/1974 | Zachman | 52/702 |
| 4,038,796 | A | | 8/1977 | Eckel | |
| 4,075,810 | A | * | 2/1978 | Zakrzewski et al. | 52/588.1 |
| 4,078,347 | A | * | 3/1978 | Eastman et al. | 52/302.3 |
| 4,223,866 | A | * | 9/1980 | Black | 249/211 |
| 4,276,730 | A | * | 7/1981 | Lewis | 52/220.2 |
| 4,296,048 | A | | 10/1981 | Sim | |
| 4,341,051 | A | * | 7/1982 | Sim et al. | 52/702 |
| 4,349,491 | A | * | 9/1982 | Eyden | 264/35 |
| 4,422,792 | A | * | 12/1983 | Gilb | 403/232.1 |
| 4,527,372 | A | * | 7/1985 | Ryan | 52/334 |
| 4,594,017 | A | | 6/1986 | Hills | |
| 4,879,856 | A | | 11/1989 | Jones | |
| 4,982,548 | A | * | 1/1991 | Abbey | 52/702 |
| 5,058,352 | A | | 10/1991 | Loiselle | |
| 5,063,718 | A | * | 11/1991 | Nonis | 52/235 |
| 5,195,293 | A | * | 3/1993 | diGirolamo et al. | 52/745.13 |
| 5,367,853 | A | * | 11/1994 | Bryan | 52/702 |

(Continued)

OTHER PUBLICATIONS

Steel Network, Inc., Load Bearing Wall Systems, Nov. 2004, pp. 30, 31, 33 and 43; The Steel Network, Inc., Raleigh, NC.

*Primary Examiner* — Khoi Tran
*Assistant Examiner* — Jason Holloway
(74) *Attorney, Agent, or Firm* — Calhelha & Doyle, LLC

(57) ABSTRACT

A light steel framing construction technique for light gauge load bearing wall type buildings uses specialized brackets to suspend poured slab floors. Multiple stories of the building can be erected without waiting for individual concrete slab floors to be poured and set at each story. During construction, a building is protected from torsional warping, such as may be occur under wind loads, by a series of lateral and diagonal bracing structures at each level affixed in a plane perpendicular to the load bearing elements. Multiple concrete floor slabs can be poured sequentially or simultaneously, as desired, during the construction process.

8 Claims, 19 Drawing Sheets

U.S. PATENT DOCUMENTS 5,551,135 A 9/1996 Powers, III
5,657,596 A 8/1997 Powers, III
5,934,036 A * 8/1999 Gallagher, Jr. ..... 52/323
5,956,910 A * 9/1999 Sommerstein et al. ..... 52/235
6,131,358 A * 10/2000 Wise ..... 52/702
6,463,711 B1 * 10/2002 Callies ..... 52/702
6,470,644 B2 * 10/2002 James et al. ..... 52/745.06
7,424,793 B1 * 9/2008 Shriver ..... 52/235
7,765,753 B1 * 8/2010 Shriver ..... 52/235
7,845,138 B2 * 12/2010 Groothuis ..... 52/742.1
2002/0078646 A1 * 6/2002 Eaton ..... 52/292
2003/0033764 A1 * 2/2003 Ting ..... 52/235
2004/0129845 A1 * 7/2004 Whale et al. ..... 248/201
2006/0016139 A1 * 1/2006 Beck et al. ..... 52/289
2006/0230697 A1 * 10/2006 Lupton ..... 52/334
2007/0204540 A1 * 9/2007 Stahl et al. ..... 52/274

* cited by examiner

Fig. 14
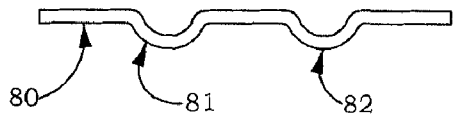
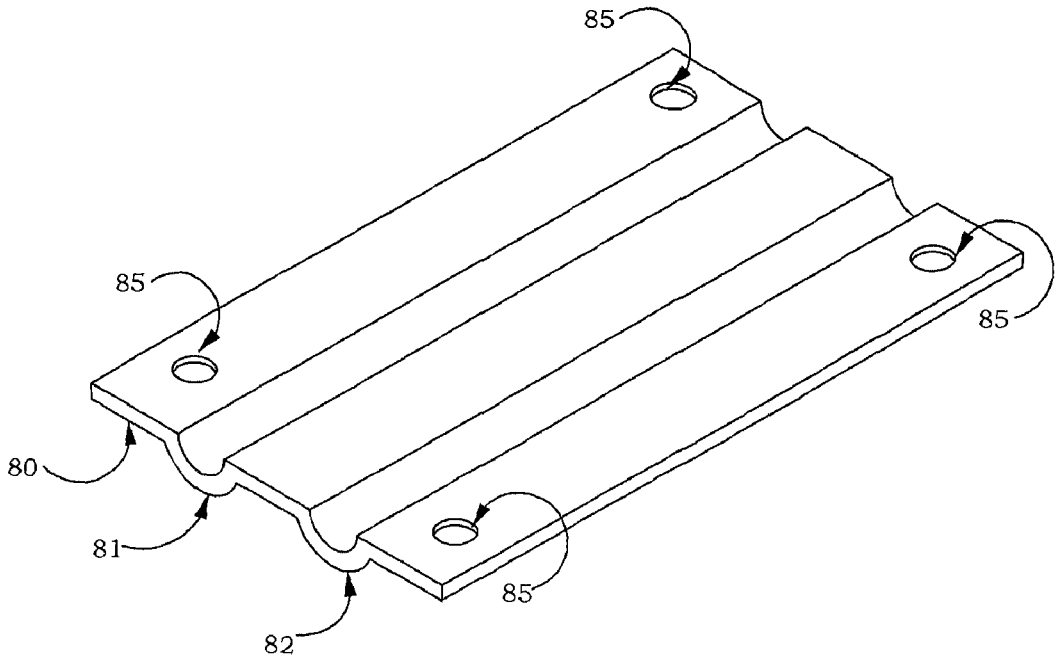
Fig. 14A

Prior Art

EXPRESS FRAMING BUILDING CONSTRUCTION SYSTEM

CROSS-REFERENCE TO RELATED APPLICATION

This application claims the benefit of provisional patent application Ser. No. 60/713,455, filed Sep. 1, 2005 by the present inventors.

FEDERALLY SPONSORED RESEARCH

Not Applicable

SEQUENCE LISTING OR PROGRAM

Not Applicable

BACKGROUND OF THE INVENTION

1. Field of the Invention

The present invention relates to new building structures and to an improved method of building construction. In particular, the invention provides improvements to light gauge steel framed building construction techniques in load bearing applications.

2. Prior Art

Light gauge steel framed buildings, such as mid-rise buildings having up to about six stories in height offer cost-effective construction and a number of additional advantages including ease of construction as well as warp, fire, rust and pest resistance.

Currently, mid-rise buildings, constructed with light gauge steel stud bearing walls, and concrete slab floors use "Platform Framing" methodology. Platform framing construction is that type of building where the floor system rests directly above and upon the walls below. Therefore, the continuation of the building erection process depends entirely upon the pouring and curing of each successive concrete floor. This method requires waiting for the concrete floor to cure or set in order to support imposed loads during further construction. Also, the poured slab floor must attain enough surface hardness to resist damage. If the building is constructed during winter conditions, providing temporary heat to protect the curing concrete can be quite cumbersome and costly. The problem of protecting concrete is exacerbated when the concrete is open to the weather in the absence of enclosing walls and a ceiling or roof above. Poured concrete which is subject to rain and wind exposure can be easily damaged.

Waiting for the concrete to be poured and to attain optimum structural properties interrupts the erection of the building frame, and results in labor force disruptions and rescheduling problems. The prompt return of work crews such as a displaced carpentry work force can be problematic. Also, the efficient use of construction equipment such as cranes is adversely affected by the interruption of the framing process. Either the crane sits idle, which is costly, or the crane leaves the site and its timely return is as problematic as that of the other work crews.

Therefore, current construction methods result in the interruption of the carpentry, plumbing, electrical and other trades, and makes the pouring of concrete inefficient and subject to inordinate delays.

3. Objects and Advantages

The express framing building construction system of the present invention offers numerous advantages for the construction of mid-rise buildings. The system can drastically reduce the time required to construct the "shell" of a mid-rise building, perhaps by as much as two thirds, by allowing the concrete floor slab to be poured at any convenient time. Furthermore, the slab can be poured in an enclosed area, protecting the un-cured concrete from rain and wind. The system allows the un-cured concrete floor slab to be heated more efficiently during cold weather and eliminates the need for tenting or temporary shelter. During extreme weather conditions, the pouring of the floor slabs can be postponed until auxiliary heating no longer needs to be supplied.

The express framing system of the present invention is safer because it allows the pouring of the concrete floor slab to be performed in a safer, interior environment by providing actual exterior walls to protect workers from falling from the building.

The express framing system allows for the continuous erection and framing of the building shell. The construction crews do not have to wait for a slab to be poured or to sufficiently harden before proceeding to the next story.

The express framing system eliminates the need for a pour stop or projected edge on the floor framing. A pour stop is necessary in conventional platform construction to cover retain the concrete until it sets. The present method eliminates the need to sheath the band of concrete at the edge of the slab.

The express framing system provides continuous walls and also allows wall insulation to be vertically continuous throughout the building; thereby insulating the so-called exposed "slab edge". This method is energy efficient and provides a warmer floor.

The express framing system reduces the expenses incurred for equipment and subcontracted services, such as cranes and construction elevators and hoists, due to the reduction in the time it takes to construct the building shell.

The express framing system provides a better connection between the successive stories of walls because the walls are connected directly to each other. This is especially advantageous when connecting the building's walls together vertically. Here, the elimination of bolts installed through a concrete slab is of enormous value.

The express framing system allows the erection of a complete building shell, properly braced against all gravity and lateral loading conditions, without the pouring of the concrete floor slabs. The concrete floor slabs can be poured at a time of the construction managers choosing. The slabs can be poured under the cover and protection of the floor system above (i.e., the slab decking above) and the exterior sheathed walls. If necessary, the slab can be heated within an enclosed building shell. The continuous nature of the framing or erection of the building results in much more scheduling control for the building construction manager or contractor.

Other objects, features and advantages of the present invention will be apparent upon consideration of the following detailed descriptions and the accompanying drawings, which should be construed as illustrative and not limiting.

SUMMARY OF THE INVENTION

A light steel framing construction technique for load bearing type buildings is provided. Multiple stories can be erected without waiting for individual concrete slab floors to be poured at each story. The building under construction is protected from torsional warping, such as may be expected under wind loads, by installation of floor decking at each level. Additional torsional or warp resistance may be provided by a series of lateral and diagonal bracing structures at each level, affixed in the plane perpendicular to the load bearing elements. Multiple concrete floor slabs can be poured simultaneously upon the previously installed metal decks, or, sequentially as desired, during the construction process.

Walls, consisting of light gauge, cold formed steel studs are erected on a foundation or other super-structure. The walls may be sheathed with an appropriate sheathing product, and many types are available. Such walls may be panelized off-site or framed at the building site.

The express framing building construction system provides several types of brackets for supporting joists and floor decking. These brackets are placed on or near the top of the load bearing walls.

In one embodiment of the present system, joist support angle brackets are affixed near the upper portion of parallel walls to support conventional joist constructions running between such walls. A second pair of walls perpendicular to the foregoing have decking support angles affixed near the top of such walls. The decking support angles are therefore parallel to the joists and perpendicular to the joist support angle brackets. Both the brackets and angles, in combination with the requisite joists, are capable of supporting the floor decking. The floor decking is typically corrugated metal decking. Additional bracing may be utilized to reinforce the wall, bracket and joist sub-assembly. Thereafter, the foregoing construction may be completed by pouring a concrete slab floor at any desired time.

In another embodiment, the express framing building construction system utilizes a combination of unique bracket constructions including a suspended slab joist support bracket and a suspended slab deck support bracket. The suspended slab joist support brackets may be of an exterior-type or interior-type, depending on the requirements of the building under construction. In this context, the expression "suspended slab' refers to the fact that the poured concrete floor does not rest directly on top of the load bearing walls, as in conventional platform framing construction. Rather, in the express framing system, the slab floor is supported by the joists and decking in combination with the unique angles and brackets disclosed herein.

In practice, floor joists are placed atop either the joist support angle brackets or into the stirrups of the suspended slab joist support brackets and fastened securely, such as by bolts that utilize pre-drilled slotted holes in the brackets or stirrups.

Warp resisting or diaphragm bracing may be applied in diagonal or other patterns and fastened across or below the floor joists. Preferred bracing is comprised of reinforcing stiffened strapping as will be discussed below. The bracing web ends are fastened at each end and may be attached to light gauge steel clip angles or other conventional fasteners. Additionally, the bracing web may be intermittently fastened along its length to construction members requiring reinforcement. For example, it may be applied to the joist members to prevent twisting and swaying.

Similarly, lateral bracing may be applied perpendicular to and across or below the bottom of the joists. Although the preferred lateral bracing is stiffened strapping, conventional hat channel may be used. The ends of the diaphragm bracing may be attached to light gauge steel clip angles.

Thereafter, a roof or floor deck, usually a metal deck and particularly a steel deck, is installed over the joists. The decking is attached to the joists and to either the horizontal leg of the suspended slab deck support brackets or to the alternative decking support angle brackets.

In general, each building story is constructed of exterior bearing walls, interior bearing walls, the floor system and the decking. In the present invention, each story is a self-contained structural element capable of resisting all loads which it has been designed to carry or resist, as a component of the building as a whole. Once each story is framed with the present system, the next higher story can be constructed. This is accomplished by erecting the next higher set of walls directly above and resting on the upper load bearing surface of the walls of the preceding lower story. The process repeats itself until all stories of the building have been framed or erected.

In such a system, scheduling the pouring of the concrete floor slabs is discretionary. The framing and erection of the building can be performed without interruption and independently of the need to pour and cure the concrete slab floors.

BRIEF DESCRIPTION OF THE DRAWINGS

In FIG. 10, the metal decking is surrounded by two sets of parallel suspended slab joist brackets and, parallel to these, two other sets of parallel suspended slab deck support brackets, thereby creating a form or mold for a poured slab deck.

FIG. 11 also depicts the first slab deck or sheathing, suspended from the first story load bearing walls.

FIG. 14 depicts a cross-section of stiffened reinforcement strapping, having arc-shaped flutes for added strength, and used for lateral or diagonal bracing. FIG. 14*a* depicts a length of the stiffened reinforcement strapping having continuous arc-shaped flutes.

DETAILED DESCRIPTION AND PREFERRED EMBODIMENTS

Figure 1:
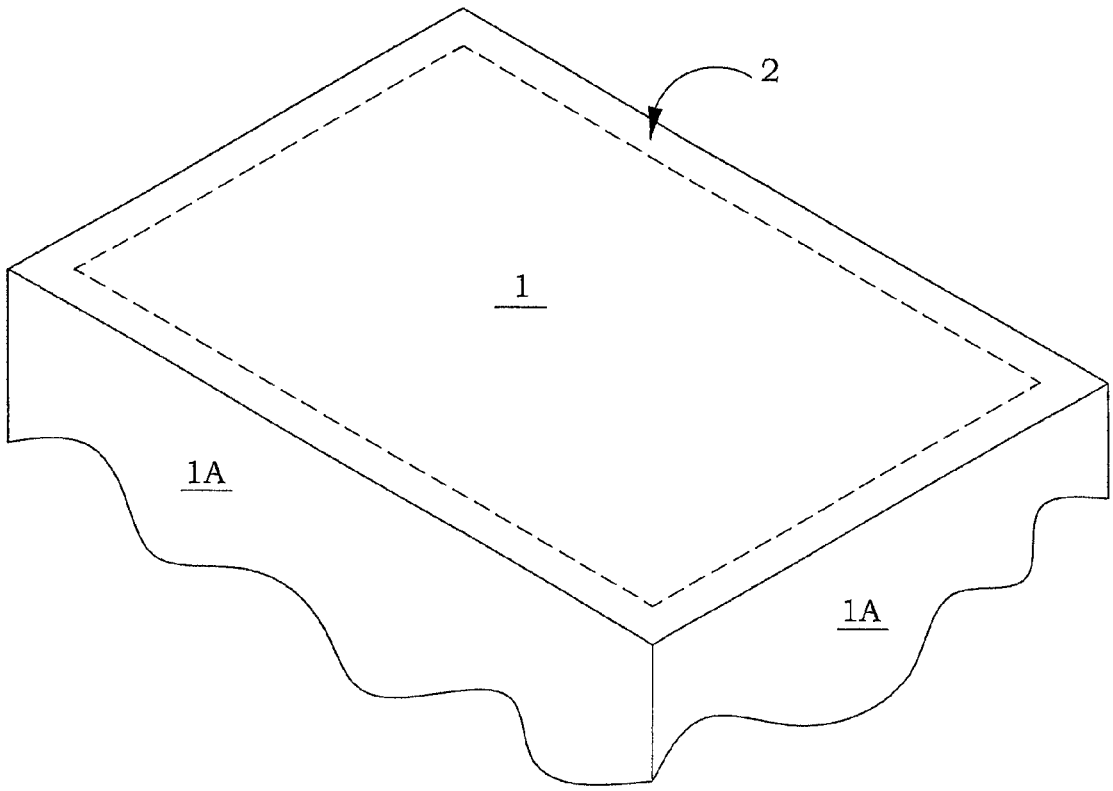
FIG. 1 is an illustration of a foundation upon which load bearing walls are to be erected.

The express framing construction system provides a method of erecting a building, and includes the steps of locating vertically extending and oppositely facing walls to form a set of joist supporting walls of a building, the joist supporting walls having upper load bearing surfaces; placing oppositely located rigid suspended slab joist supporting brackets on the wall upper surfaces; placing the ends of generally horizontal extending joists on the rigid suspended slab joist supporting brackets; and placing a sheet of slab decking on top of the joists. The decking is supported by the joists and the weight of the decking is borne by the joist supporting walls. In an alternative method, the suspended slab joist supporting brackets are replaced with joist support angle brackets affixed to load bearing elements of the joist supporting walls.

The method may include the additional step of locating a pair of oppositely placed rigid suspended slab deck support brackets on top of a pair of vertically extending and oppositely facing walls which are perpendicular to the joist supporting walls and the suspended slab joist supporting brackets. Alternatively, the slab deck support brackets may be replaced with lengths of slab deck support angles attached to the upper region of the perpendicular walls.

An additional step of bracing the wall and joist assemblies to reinforce and rigidify the assemblies and to inhibit relative twisting or warping by wind or other forces may be used. The bracing is preferably the reinforcing stiffened strapping described below.

Thereafter, the method may continue with the additional step of pouring a layer of concrete or similar floor material on top of the decking to thereby form a floor for the building.

The method works equally well with either exterior or interior load bearing walls. An interior load bearing wall will support symmetrical joist supporting brackets on opposite sides of the interior wall.

The method may include the additional step of erecting a subsequent assembly of load bearing walls, suspended slab joist and deck support brackets and suspended slab decking prior to the pouring of one or more concrete slab floors. A building constructed in accordance with the foregoing method is thereby provided.

In the express framing system, a building sub-assembly includes a lower set of vertically extending walls, an upper set of vertically extending walls, the upper set of walls resting on the lower set of walls, a bracket affixed to the lower walls, the bracket having a cantilever portion extending away from its corresponding lower wall panel, a horizontal joist extending from and having one end supported by the cantilever bracket portion, a generally horizontal decking lying atop and supported by the joist, whereby concrete may be poured at any time on the decking to form a concrete floor. This sub-assembly may include a second sub-assembly mounted on top of the first mentioned sub-assembly, thereby yielding two vertically spaced horizontal deckings, the respective walls of the two building sub-assemblies being coplanar, and whereby concrete may be poured on the two spaced horizontal deckings sequentially or simultaneously.

The construction method of the present invention utilizes a number of unique components in combination with conventional building materials. The conventional components typically include light gauge steel stud walls, sheathing, floor and roof joists, steel roofing and floor decking, and miscellaneous light gauge steel framing accessories such as angles, fasteners, clips, etc. Fasteners are generally selected as appropriate from among conventional screws, rivets and nut, bolt and washer assemblies.

In one embodiment, the first unique element utilized in the express framing system of this invention is a suspended slab joist support bracket. It may be of an exterior or interior type. This bracket is for the support of the floor joists which subsequently support the decking and poured slab. It is characterized herein as a "suspended slab" joist support bracket because, unlike conventional platform framing methods, the slab flooring is not installed atop the load bearing walls. Thus, the bracket supports or hangs the joists so that the load on the joist is eccentric to the centerline of the wall that is carrying the joist load. This bracket may form a continuous support for the floor joists and readily provides automatic "on center" distance locations for the placing of the joists.

The eccentricity of the joist support allows the walls for successive stories to be placed on and fastened to the walls directly above and below each other. And unlike conventional platform framing mentioned above, construction of successive stories need not await the pouring and curing of concrete slab flooring. Rather, sufficient warp and twist resistance is provided by installation of the joist support brackets, the joists, the floor decking, and any bracing material which is utilized.

Figure 3:
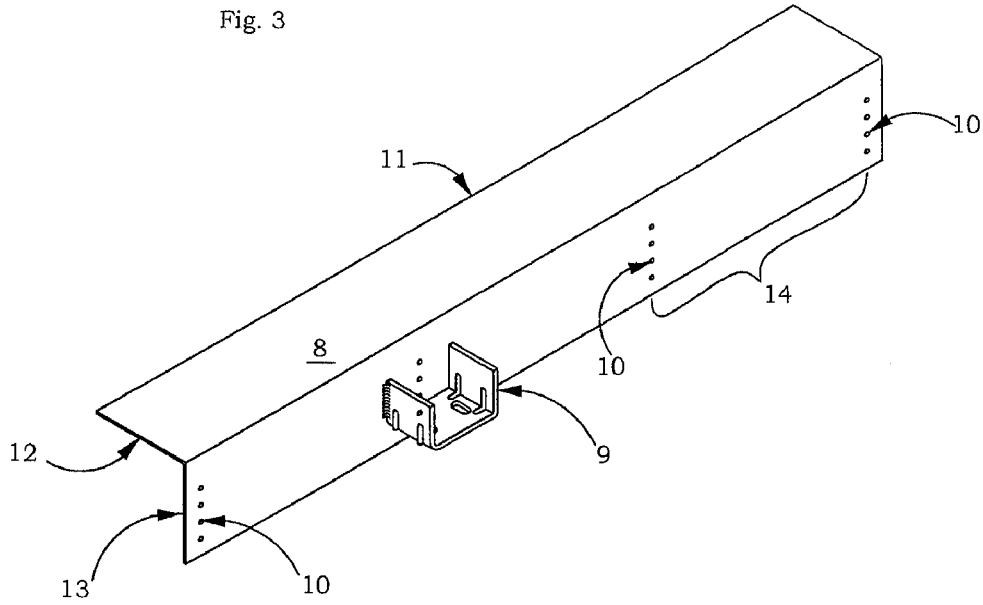
FIG. 3 illustrates a suspended slab joist support bracket having an upside-down L-shape, and including a welded stirrup to receive a joist.

The suspended slab joist support bracket 8 of FIG. 3 is an inverted L-shape having a horizontal and vertical leg with a formed "stirrup" welded to the vertical leg. The stirrup is located at the "on center" points of a load bearing wall and receives the floor joists. The stirrup is located below the horizontal leg of the bracket at a distance which equals the thickness of a subsequently poured concrete slab. The vertical face of the bracket acts as a leveling screed or pour stop to prevent the liquid slab concrete from exiting the desired area. The distance from the top of the bracket to the stirrup can be varied to achieve different results. Matching a desired slab depth with a specific stirrup location represents a typical application for bracket 8.

In this embodiment, the suspended slab joist support bracket 8 is fastened through the vertical leg of the bracket to a track atop the conventional metal studs of a bearing wall. Fastening the bracket through the vertical leg allows the coplanar wall for the next story to rest on an upper load bearing surface that is flat and free from projections such as screws. The wall of the story above is fastened through its bottom track, the horizontal leg of the bracket and the top track of the wall below. The horizontal leg of the bracket is the same width as the metal stud bearing wall upon which it rests.

In this first embodiment, a second unique element of the express framing system is an interior-type slab joist support bracket. This bracket is used on interior load bearing walls. If this bracket is made as an integral unit, stirrups are welded on both sides of an inverted U-shaped element. It is preferred however, that instead of a single integral interior bracket, a pair of symmetrical half-units will be used as described below. The vertical legs of the bracket face downward, and the horizontal leg rests on top of the upper track of the bearing wall. The interior bracket is otherwise similar to the exterior joist support bracket.

Also in this embodiment of the express framing building construction system, another unique element utilized is a suspended slab deck support bracket. These brackets are for the support of the metal decking at those of its perimeter edges which are perpendicular to those decking edges which are supported by the suspended slab deck support brackets. The bracket supports the edge of the metal decking and is located parallel to the direction of the floor joists. It forms a continuous support for the decking and also provides an automatic ledger for the slab, where no additional measuring is required.

The suspended slab deck bracket is a Z-shaped steel element having upper horizontal, vertical and lower horizontal legs. An upper horizontal leg sits on top of the wall, the vertical leg equals the depth of the concrete slab, and the lower horizontal leg supports the metal decking. The horizontal leg that supports the decking is typically about 2 in. wide. The upper horizontal leg equals the width of the bearing wall. The vertical face of the bracket also acts as a pour stop to prevent the liquid slab concrete from exiting the desired area.

The suspended slab deck bracket is fastened through the vertical leg of the bracket to the upper portion of the metal studs or top track of the bearing wall. Fastening the bracket through the vertical leg allows the wall for the next story to rest on a surface that is flat and free from projections such as screws. The wall of the story above is fastened through its bottom track, the horizontal leg of the bracket and the top track of the wall below. The upper horizontal leg of the bracket is the same width as the metal stud bearing wall upon which it rests. The suspended slab deck support brackets are installed on the walls that are parallel to the floor joists.

In an alternative embodiment of the express framing building construction system, the suspended slab joist support brackets may be replaced with joint support angle brackets which are affixed near the top of the bearing walls which support the joists. In this embodiment, deck support angles may be utilized and affixed near the top of the perpendicular walls, to receive and support the floor decking. Both such sets of brackets, in combination with the joist system and bracing, support the floor decking and the subsequently poured slab.

In both of the foregoing embodiments, and in contrast to conventional platform framing, the decking is suspended from, rather than resting upon, the load bearing walls.

Building constructions typically require the addition of reinforced bracing members. As currently used and produced, conventional flat light gauge steel strapping is quite elastic, unstable when handled improperly, and is subject to damage because it cannot support its own weight when held horizontally. Currently, it requires two carpenters to stretch flat strapping across floor and roof joists.

A further unique element of the present system is stiffened strapping for lateral or diagonal bracing. Light gauge steel strapping may be stiffened by forming one or more continuous stiffening impressions, or beads, parallel to the long dimension of the strap. Stiffening impressions, such as flutes, enable the strapping to be easily handled. The flutes greatly add to the rigidity and structural properties of the strapping.

The stiffened strapping provided herein may be used in a wide variety of applications requiring enhanced reinforcement. It is particularly useful in the subject express framing construction method where, when installed below the suspended joists and secured thereto, it serves to prevent swaying and twisting of the hanging joists.

The stiffened strapping may be used for lateral or diagonal bracing and is preferably formed from a coil of steel, which is preferably galvanized steel conforming to the requirements of ASTM A 653, having a yield strength of 33 or 50 ksi and a minimum of G-60 galvanized coating. For convenience in handling, the steel coil is decoiled and flattened by conventional means before the stiffening impressions are imparted.

The stiffening impressions may be applied to any length of coil but generally the dimensions of the strapping will be selected in accordance with the specified construction requirements and ease of handling. A typical installation will utilize 12 foot lengths of stiffened strapping having dimensions of about 2 in width and thickness of 54 mils (16 gauge). In other applications, lengths from about 2 in to 30 feet may be used as required and the width of the strapping may vary from about 1.5 in to 12 in while the thickness may vary from about 30 to 70 mils.

One or more stiffening impressions are imparted to the web by conventional mechanical metal pressing, rolling or stamping. Hot or cold methods may be utilized as appropriate.

The preferred stiffening impressions are flute-shaped impressions, but other shapes may be utilized depending upon the chosen methods of fabrication. It should be possible, for example, to create a v-shaped stiffening impression which ought to function similarly in appropriate applications. All such shapes and channels effective for stiffening the strapping are contemplated for use as the stiffening impressions. The preferred flute-shaped stiffening impressions are generally semi-circular in shape since an arc is readily impressed during fabrication.

The flutes are generally centered along the length of the strapping, or symmetrically oriented from the center line when more than a single flute is utilized. It will be recognized, however, that the stiffening flutes may be offset from the center if a larger flat edge of the strapping is required for some other function, such as securing an edge along its length.

A single stiffening impression such as a flute can be effective in some applications, especially less critical applications or where strapping lengths are minimized. Three or more stiffening impressions can be used for longer lengths of stiffened strapping or where applications will benefit from additional stiffening strength. In the subject express framing construction system, a pair of parallel flutes was impressed upon the stiffened strapping and these were found to be satisfactory.

The stiffened strapping can be readily cut to order in the fabricator's shop and transported in flat bundles to a worksite. At the worksite, the stiffened strapping is readily installed using conventional fasteners including machine and metal screws, bolts, etc. Rivets could be utilized but are no longer a popular choice.

IN THE DRAWINGS

FIG. 1 illustrates a concrete or masonry foundation 1A having a flat surface 1 upon which load bearing walls are to be erected. An outline of the location of an alternative steel beam bearing 2 is also indicated by the dotted lines.

Figure 2:
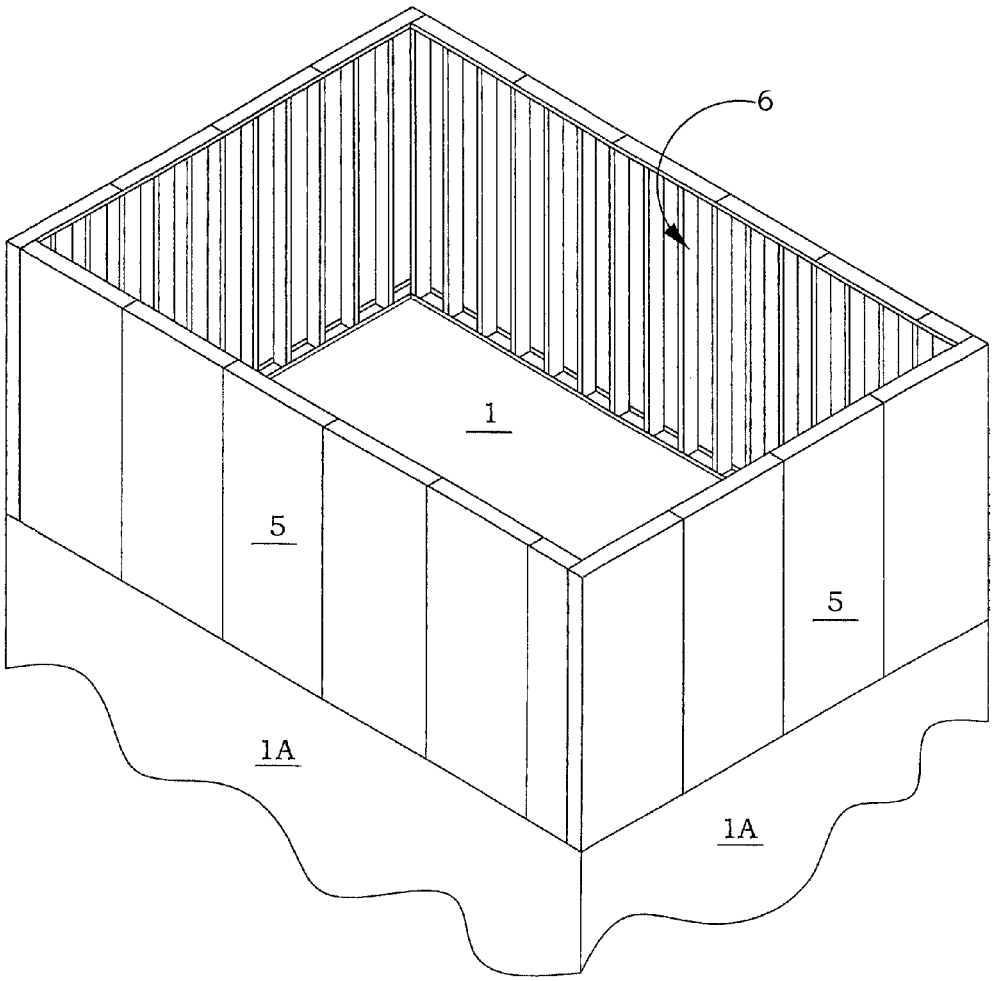
FIG. 2 depicts load bearing walls comprised of steel stud framing and sheathing panels erected on the foundation.

FIG. 2 depicts panelized load bearing walls 5 comprised of steel stud framing 6 and sheathing panels erected on surface 1 of foundation 1A.

FIG. 3 illustrates a rigid suspended slab joist support bracket 8 having an inverted L-shape, and includes a welded-thereto joist stirrup 9 to receive the joists. The joist stirrup 9 is generally U-shaped, as detailed in FIG. 5. The bracket 8 also includes pre-drilled holes 10, while a rear edge of bracket 8 is denoted as 11. The horizontal width of the top surface of bracket 8 is denoted as 12 and matches the upper load bearing surface of a wall upon which it is installed. The downward width of bracket 8 is denoted as 13 and varies with the desired depth of the poured slab flooring. In this figure, the on-center distance between later-installed studs is denoted as 14. The bracket is fastened to the vertical studs with screws through pre-drilled holes 10.

Figure 4:
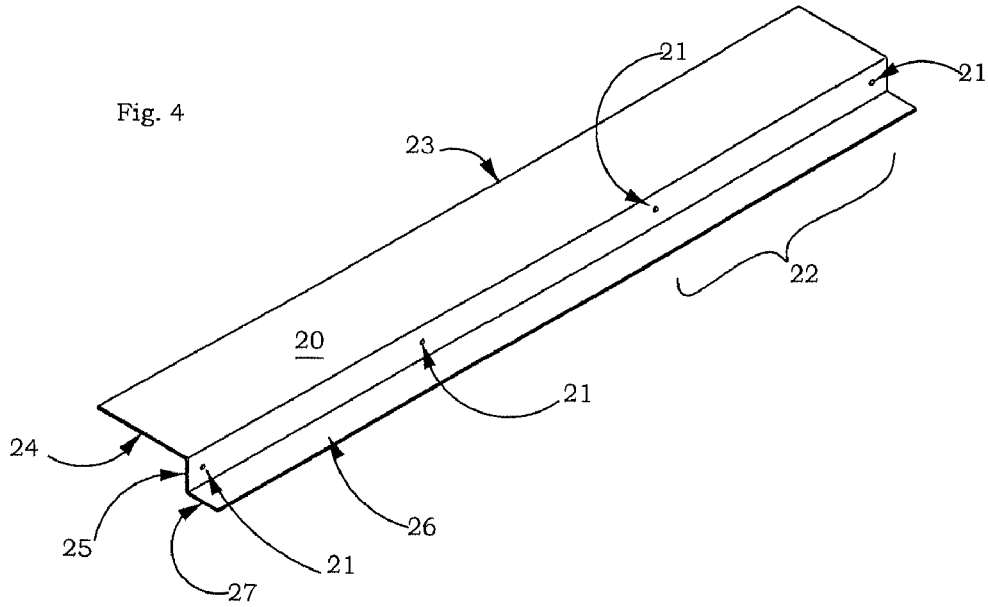
FIG. 4 illustrates a suspended slab deck support bracket having a Z-shaped element, which receives the edges of the deck sheathing and forms a seal for containing the eventual poured slab.

FIG. 4 illustrates a rigid suspended slab deck support bracket 20 which is generally Z-shaped, and which receives the edges of the deck sheathing and forms a seal for the later poured concrete slab. Slab deck support bracket 20 includes pre-drilled holes 21. The later-installed stud on-center distance is denoted as 22. A horizontal rear edge of bracket 20 is denoted as 23. The slab deck support bracket 20, placed atop a wall parallel to the joists, has a first or upper horizontal edge or width 24, a vertical edge 25, and a second or lower horizontal edge or width 27. Deck support lip 26 lies in a horizontal plane.

Figure 5:
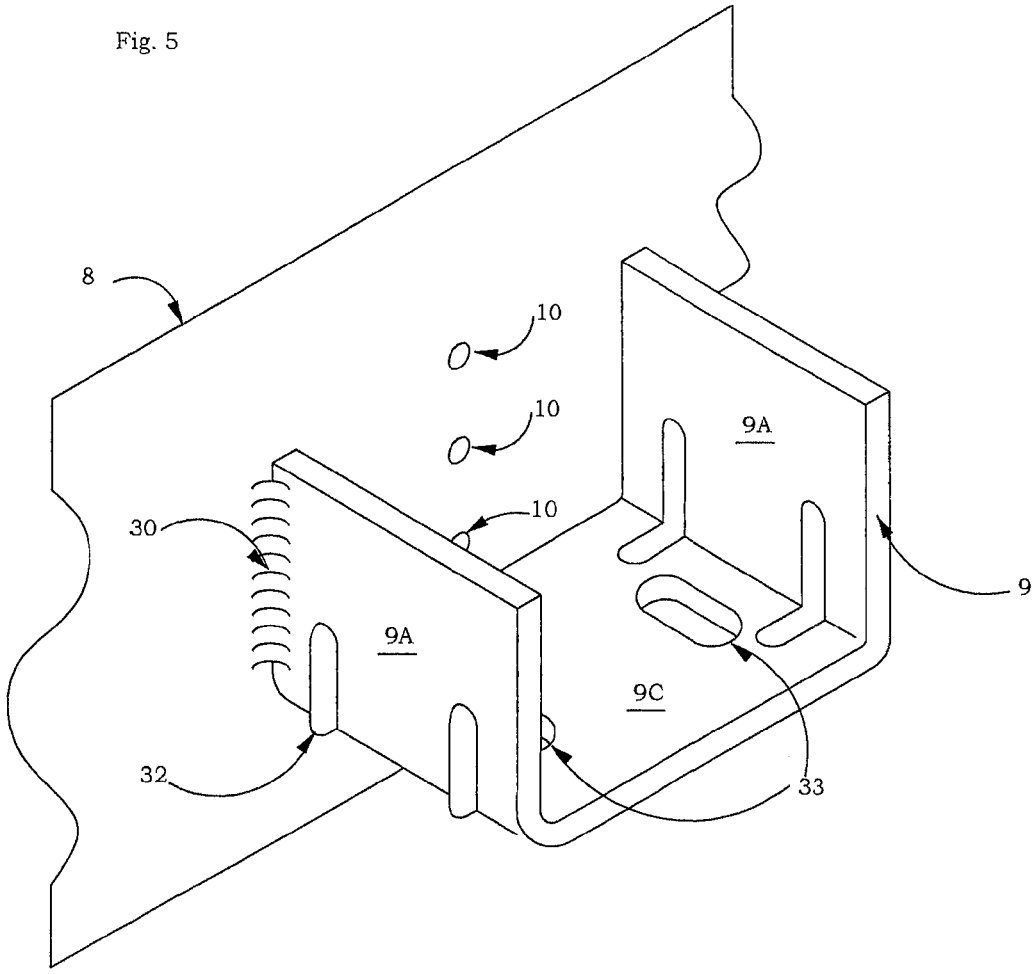
FIG. 5 is a detail of a joist support stirrup.

FIG. 5 is a detail of a joist support stirrup 9 of FIG. 3. Reference numeral 9 denotes a joist stirrup which in this embodiment has typical dimensions of 4 in by 3 in by 2.5 in. Reference numeral 9*a* denotes either of two vertical side portions, while 9*c* denotes a flat, cantilever portion. Pre-drilled attachment holes 10 are in a vertical portion of 8, while the stirrup 9 is welded at 30 to provide a slab joist support. Crimped reinforcing ribs 32 are provided on the outside walls of stirrup 9. Pre-drilled, elongated holes 33 are provided at the bottom, flat portion of the stirrup.

Figure 6:
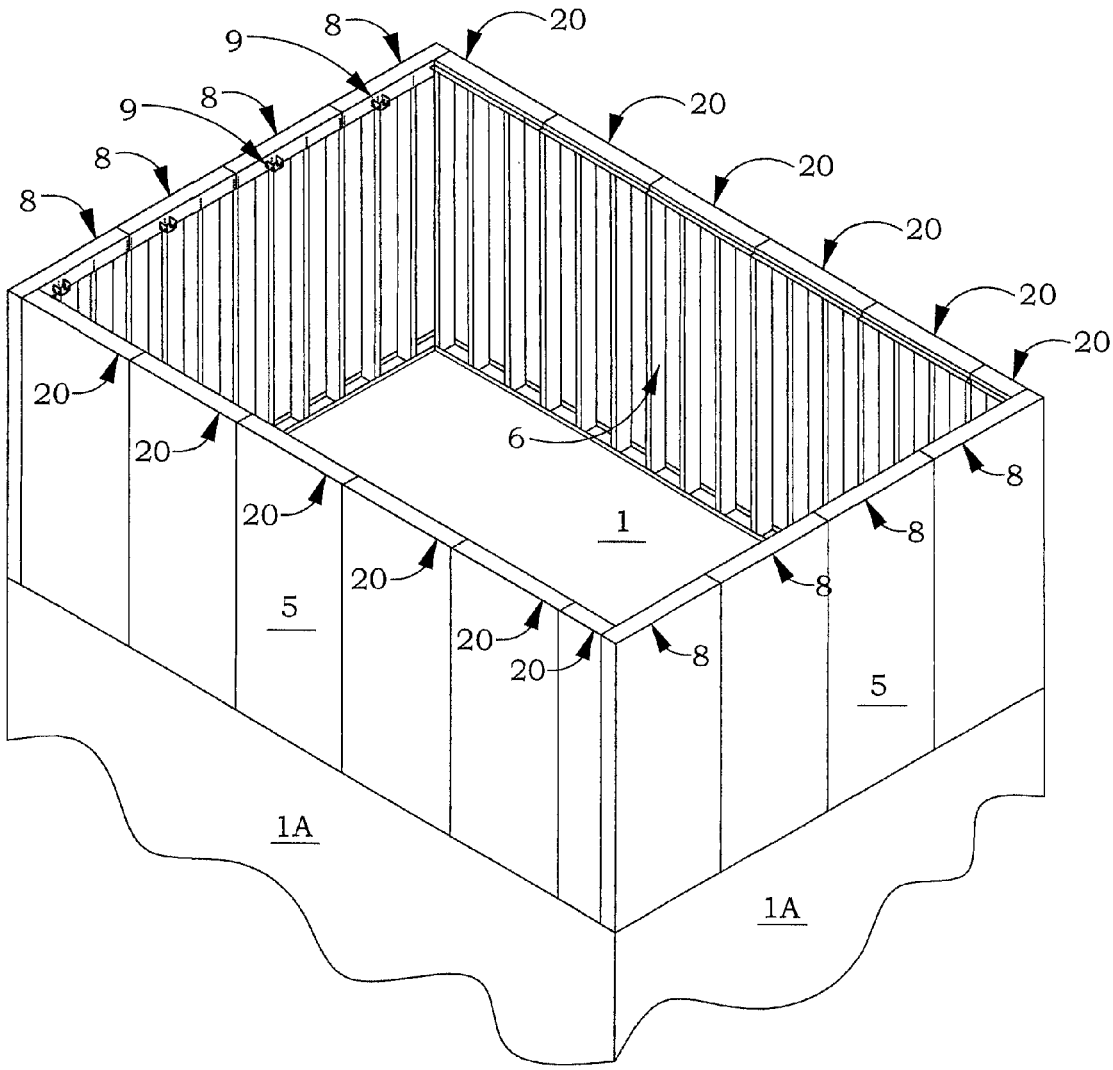
FIG. 6 illustrates pairs of suspended slab joist support brackets installed opposite each other, atop parallel load bearing walls; and pairs of suspended slab deck support brackets installed perpendicular to the joist brackets, atop the remaining walls.

FIG. 6 illustrates several suspended slab joist support brackets 8 installed in pairs opposite each other, atop parallel load bearing walls, and also includes several suspended slab deck support brackets 20 installed perpendicular to the slab joist support brackets and atop the remaining walls which run lengthwise.

Figure 7:
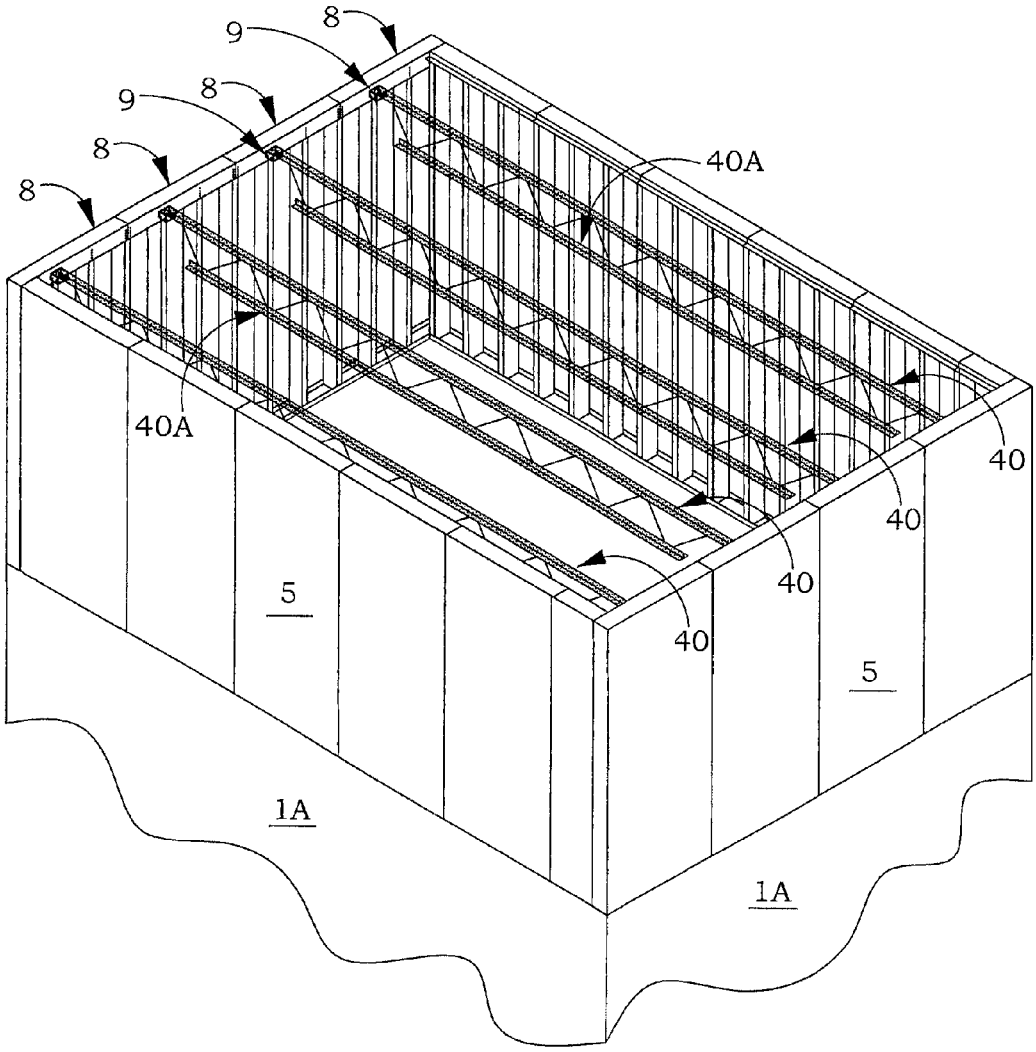
FIG. 7 illustrates joist assemblies installed between the suspended slab joist support brackets.

FIG. 7 illustrates several joist assemblies 40 installed between the suspended slab joist support brackets 8, the joist ends resting in respective stirrups 9. Each joist may include a lower strut 40*a* such as may be utilized for supporting a suspended ceiling or to affix reinforcing bracing. The bracing may be stiffened strapping described herein.

Figure 8:
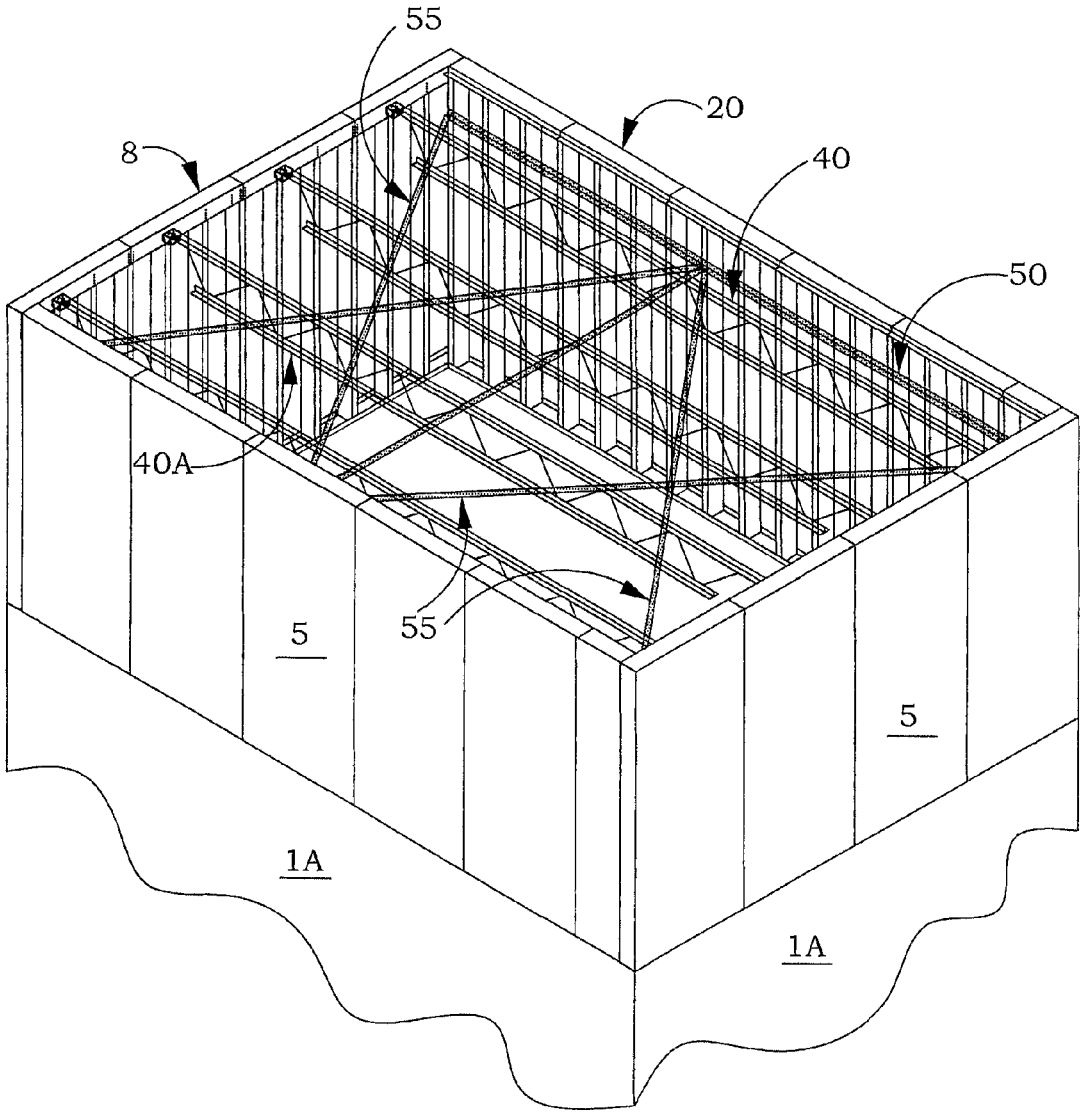
FIG. 8 illustrates diagonal or diaphragm bracing reinforcing the structure before a suspended slab deck is laid down and a slab floor is poured.

FIG. 8 illustrates several diagonal bracing members 55 reinforcing the structure before a deck and concrete slab are installed. Such bracing is preferably stiffened strapping which is fastened to conventional clip angle 50.

Figure 9:
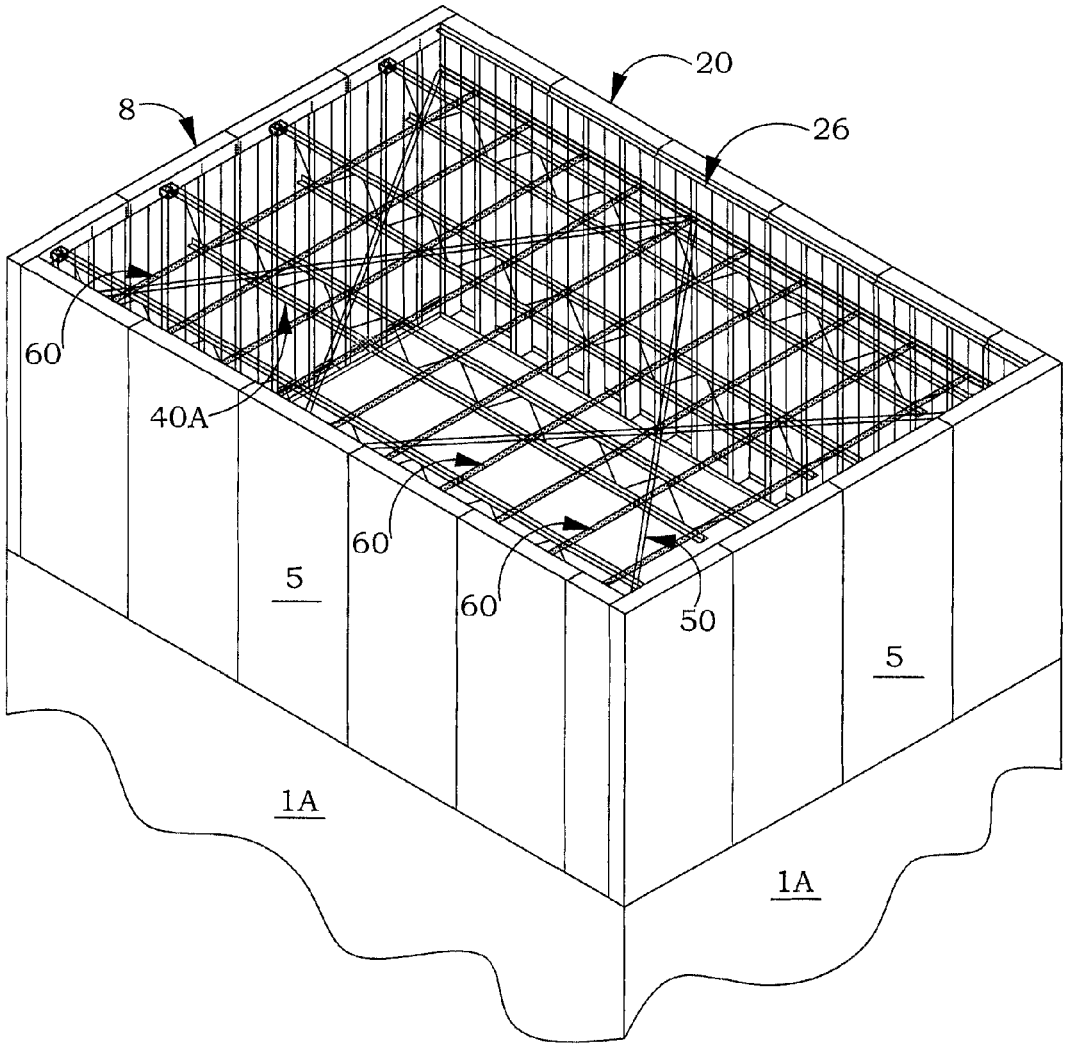
FIG. 9 illustrates additional reinforcement with lateral bracing.

FIG. 9 illustrates additional reinforcement with lateral bracing 60, the latter attached to respective pairs of opposite walls 5. Again, the preferred bracing is stiffened strapping.

Figure 10:
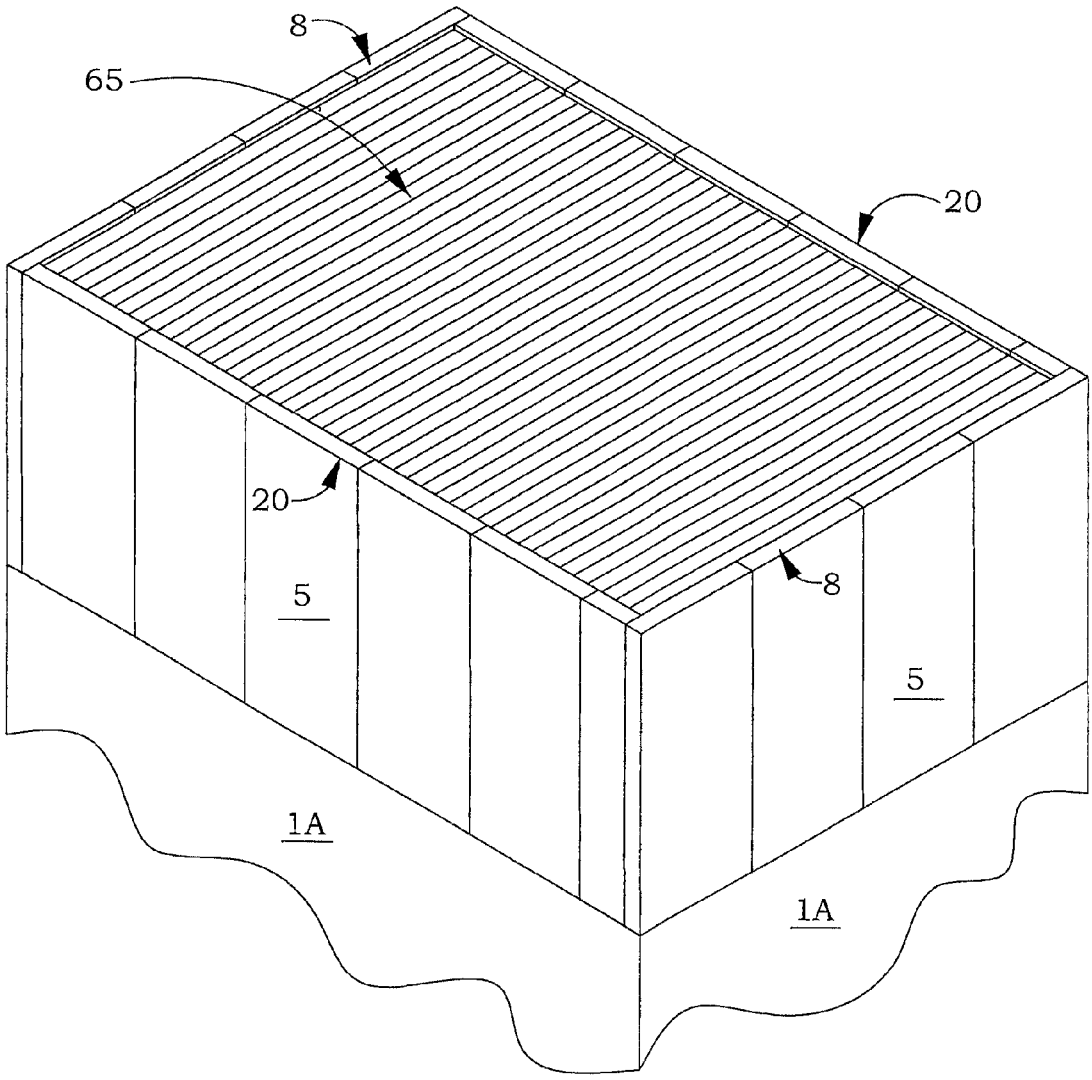
FIG. 10 illustrates metal decking which will receive a poured slab installed atop the joists.

FIG. 10 illustrates decking 65 which is usually corrugated metal decking and which is installed atop underlying joists and which will receive a poured slab on top thereof. The decking is peripherally surrounded by slab joist brackets 8 and slab deck support brackets 20 to create a form or mold for the poured slab deck. The concrete may be poured at any convenient time on decking 65.

Figure 11:
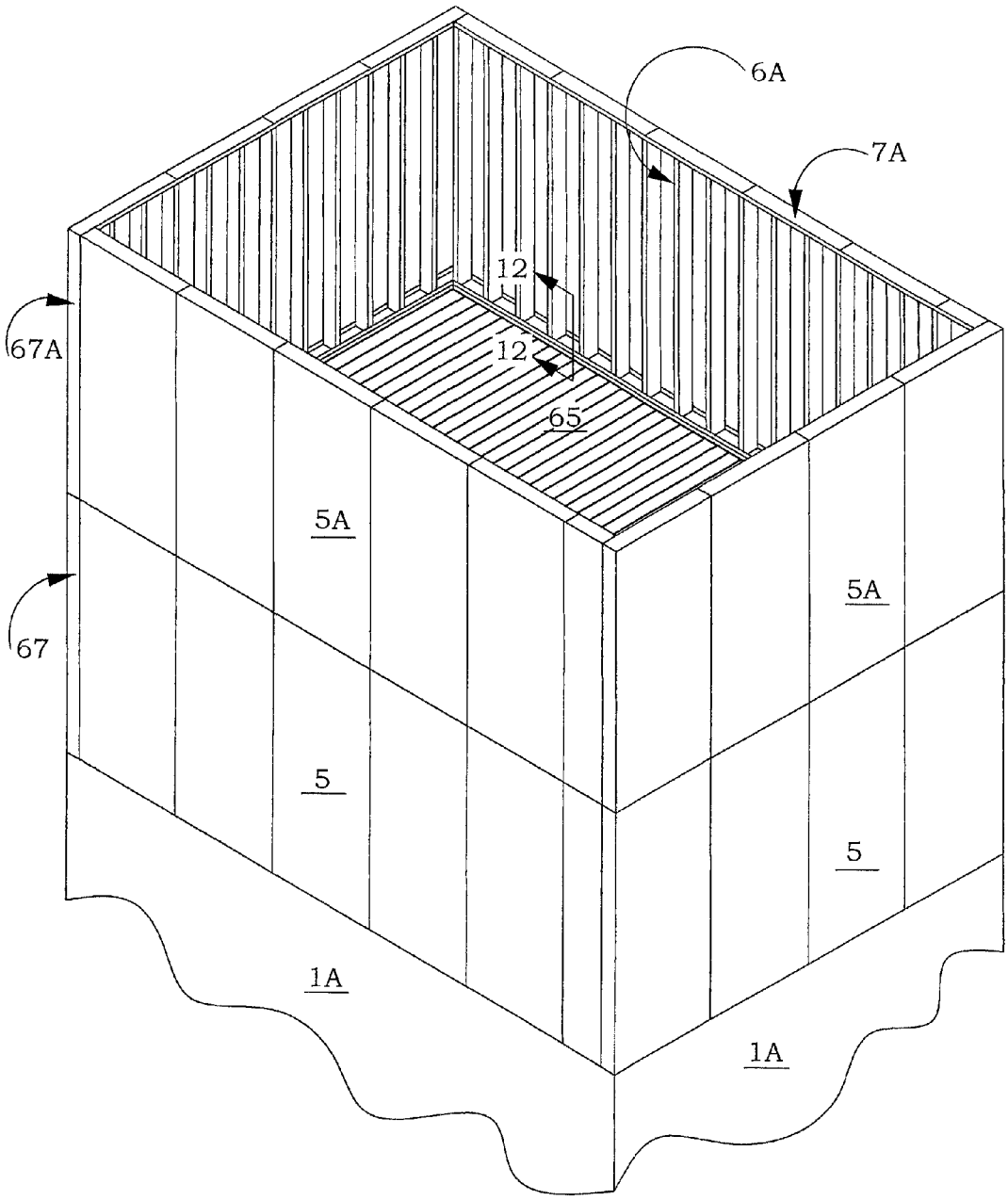
FIG. 11 illustrates a second story of load bearing walls erected atop the first story prior to the first deck slab being poured.

FIG. 11 illustrates the construction of a second story 67A atop a lower load bearing first story 67. The first and second stories are comprised of wall sections 5 and 5A, respectively. The walls are sheathed with conventional sheathing panels or sections. Decking 65 is ready to receive concrete to form a poured slab deck. The illustrated second or upper story 67A utilizes steel stud framing 6A interior to the sheathing panels which together comprise the load bearing wall construction which supports any subsequent stories.

Figure 12:
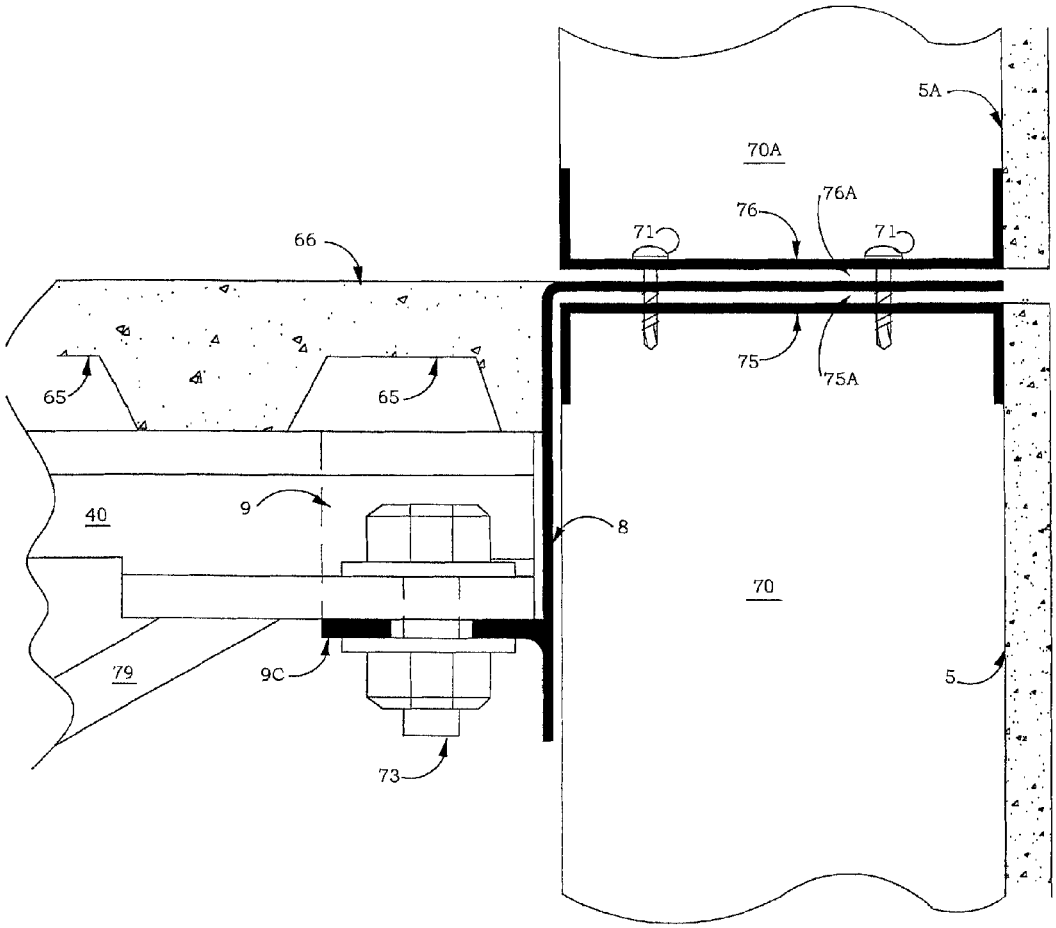
FIGS. 12-13 illustrate construction details.

FIG. 12 is a cross-section of the suspended slab joist support bracket 8, taken along 12-12 of FIG. 11, installed between lower wall 70 and upper wall 70*a* and secured with screw fasteners 71. For clarity, seams 75A and 76A are exaggerated. Fluted metal decking 65 supports poured concrete deck slab 66. An end of a joist 40 is inserted into joist stirrup 9 and secured with bolt, nut and washer assembly 73. One end of joist 40 is supported by cantilever portion 9*c* of stirrup 9.

Figure 13:
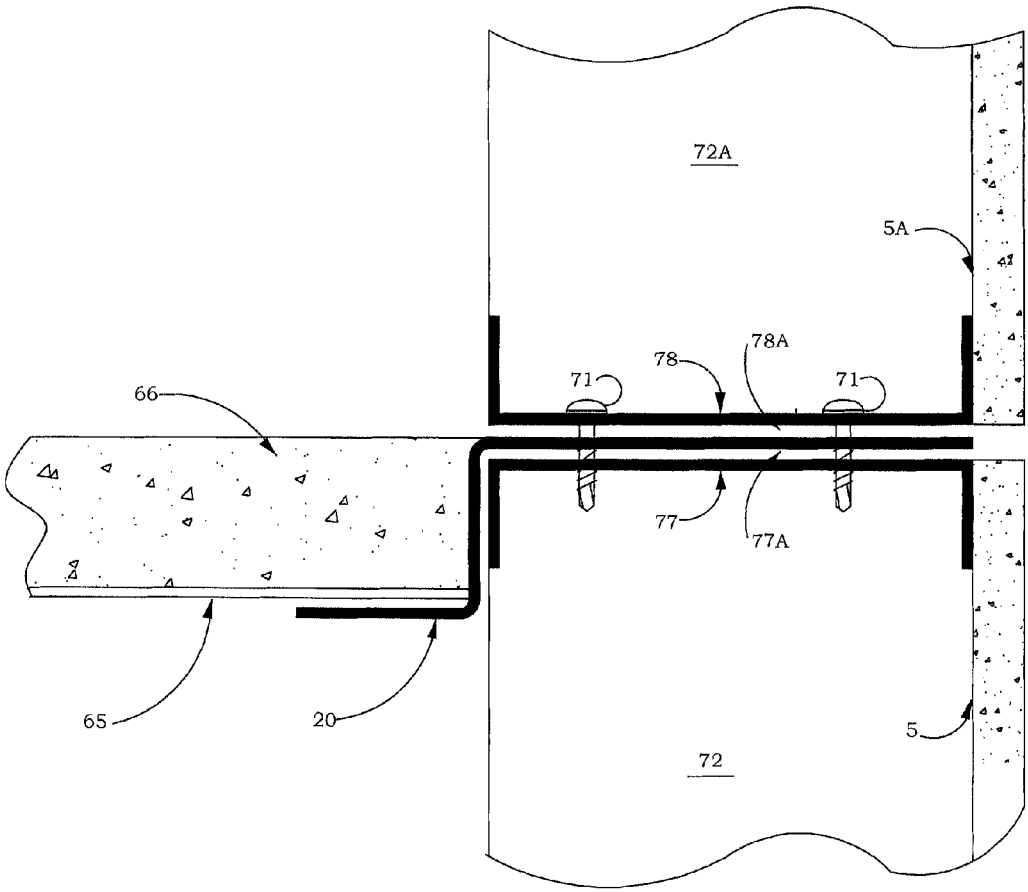

FIG. 13 is a cross-section detail of the suspended slab deck support 20 installed between lower light gauge wall 72 and upper light gauge wall 72*a* and secured through wall tracks 77 and 78 with screw fasteners 71. Seams 77A and 78A are exaggerated for clarity. It will be noted that the suspended slab deck support 20 and walls 72 and 72*a* depicted in FIG. 13 are perpendicular to walls 70 on 70*a* and suspended slab joist support 8 illustrated in FIG. 12. Also depicted in FIG. 13 is concrete decking slab 66 poured atop metal decking 65.

FIG. 14 depicts a cross-section of a stiffened reinforcement strapping 80, the latter provided with continuous and parallel stiffening impressions which in this embodiment are flutes 81 and 82. The stiffened strapping used for the lateral and diagonal bracing is seen for example as diagonal bracing 55 in FIG. 8 and lateral bracing 60 in FIG. 9. The strapping width in this figure has a width of about 2 inches. FIG. 14A is a perspective view of the stiffened reinforcement strapping 80, further illustrating its parallel strengthening flutes, 81 and 82. Holes 85 may be used to fasten the stiffened strapping.

Figure 15:
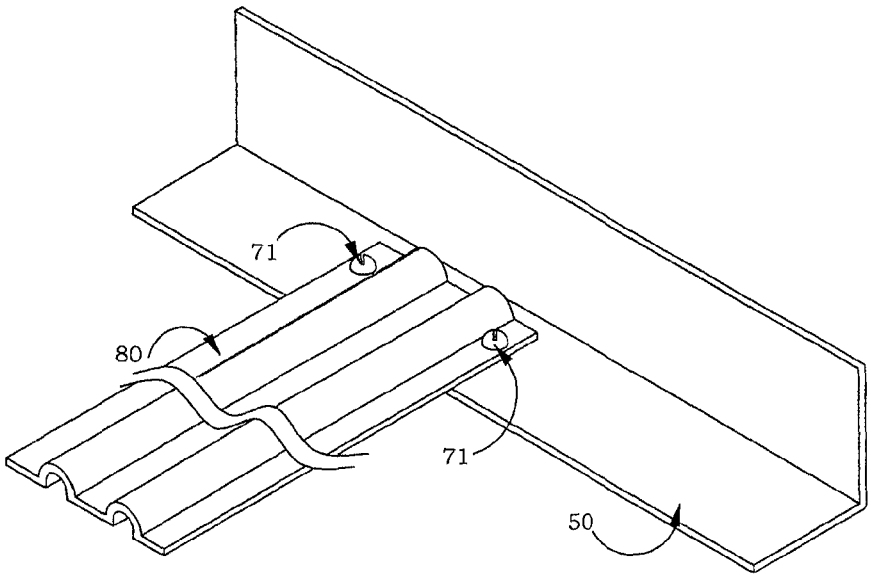
FIG. 15 is a detail depicting the attachment of the stiffened bracing to a clip angle.

FIG. 15 is a detail depicting the attachment of lateral bracing 80 to clip angle 50. Diagonal bracing is similarly attached. Fasteners 71 pass through preformed openings to secure the bracing to the angle. Conventional fasteners, clip angles, screws and the like are selected as may be appropriate in a given application.

Figure 16:
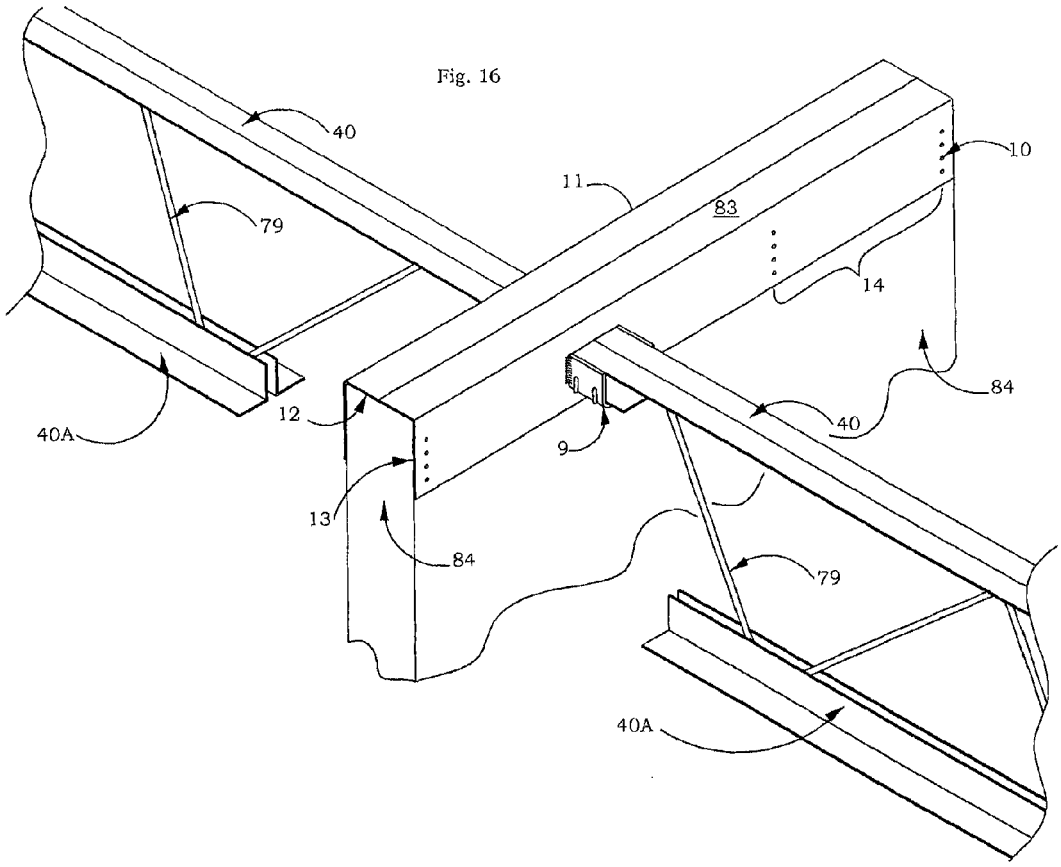
FIG. 16 is a detail depicting installation of a double or interior type suspended joist saddle bracket installed atop an interior load bearing wall.
Figure 17:
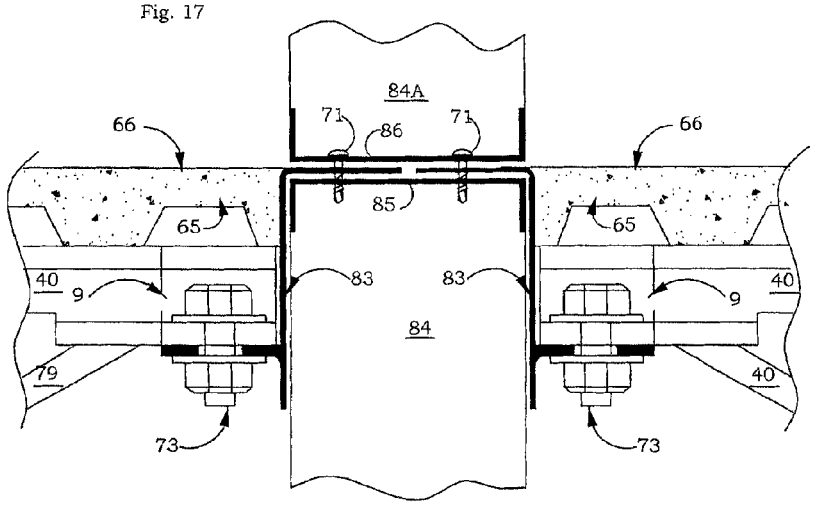
FIG. 17 is a cross-section of an installed double or interior type suspended joist saddle bracket construction assembly.

FIG. 16 is a detail perspective depicting installation of an interior-type suspended slab joist saddle bracket 83 installed atop an interior load bearing wall 84. The saddle bracket may be a single, symmetrical unit or may be comprised of a pair of symmetrical half-units as illustrated in FIGS. 16 and 17. In either case, joists hang on opposite sides of interior load bearing wall 84. The joists are herein depicted with struts 79 and lower joist tracks 40A.

FIG. 17 is a cross-section showing symmetrical interior suspended joist saddle brackets 83 installed atop an interior load bearing wall 84. It will be observed that lower wall 84 and upper wall 84A of FIG. 17 are substantially coplanar. That is, each lies in the same vertical plane. This also the case for walls 70 and 70A of FIG. 12, and for walls 72 and 72A of FIG. 13. In FIG. 17, joists 40 are secured to brackets 83 by nut and bolt assemblies 73. Corrugated decking 65 and poured slab 66 are shown. Bearing walls 84 and 84A are capped with tracks 85 and 86 and secured with screw fasteners 71.

Figure 18:
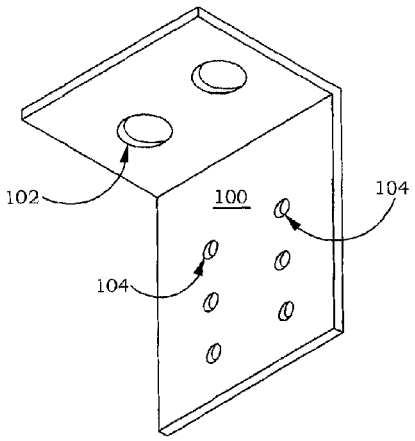
FIG. 18 is a perspective view of a joist support angle bracket.

In an alternative embodiment of the present invention, the suspended slab joist support brackets described above may be replaced with joist support angle brackets. FIG. 18 is a perspective view of a joist support angle bracket 100 having holes 102 for fastening a joist to bracket 100, typically via a bolt, nut and washer assembly. In the figure, bracket 100 also has holes for fastening the bracket to the top track of a bearing wall or stud. Holes 104 may receive bolts or other fasteners but will typically utilize screws for securing brackets 100 to the track or studs.

Figure 19:
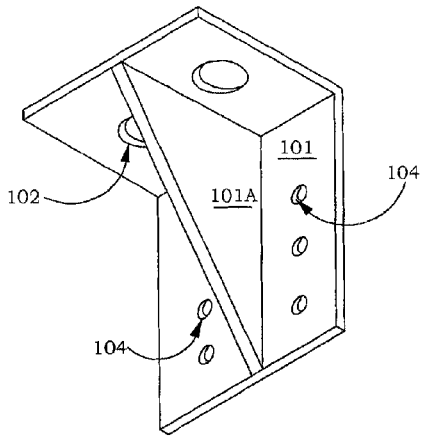
FIG. 19 is a perspective view of a reinforced joist support angle bracket.

FIG. 19 is a perspective view of an alternative reinforced joist support angle bracket 101 additionally having reinforcing member 101A. Reinforcing member 101A is typically a metal wedge welded in placed or forged in the initial fabrication of the bracket.

Figure 20:
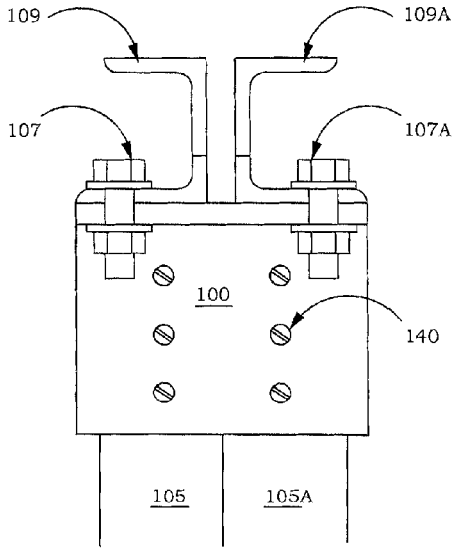
FIG. 20 is an elevation view of a joist support angle bracket installed on stud framing and securing a joist seen in cross-section.

FIG. 20 is an elevation view of joist support angle bracket 100 installed with fasteners 140 on left and right stud framing members 105 and 105A. In this embodiment, fasteners 140 may be metal screws. In this figure, left and right portions of a joist section 109 and 109A are seen in cross-section and are secured to joist support angle bracket 100 by nut, bolt and washer assemblies 107 and 107A.

Figure 21:
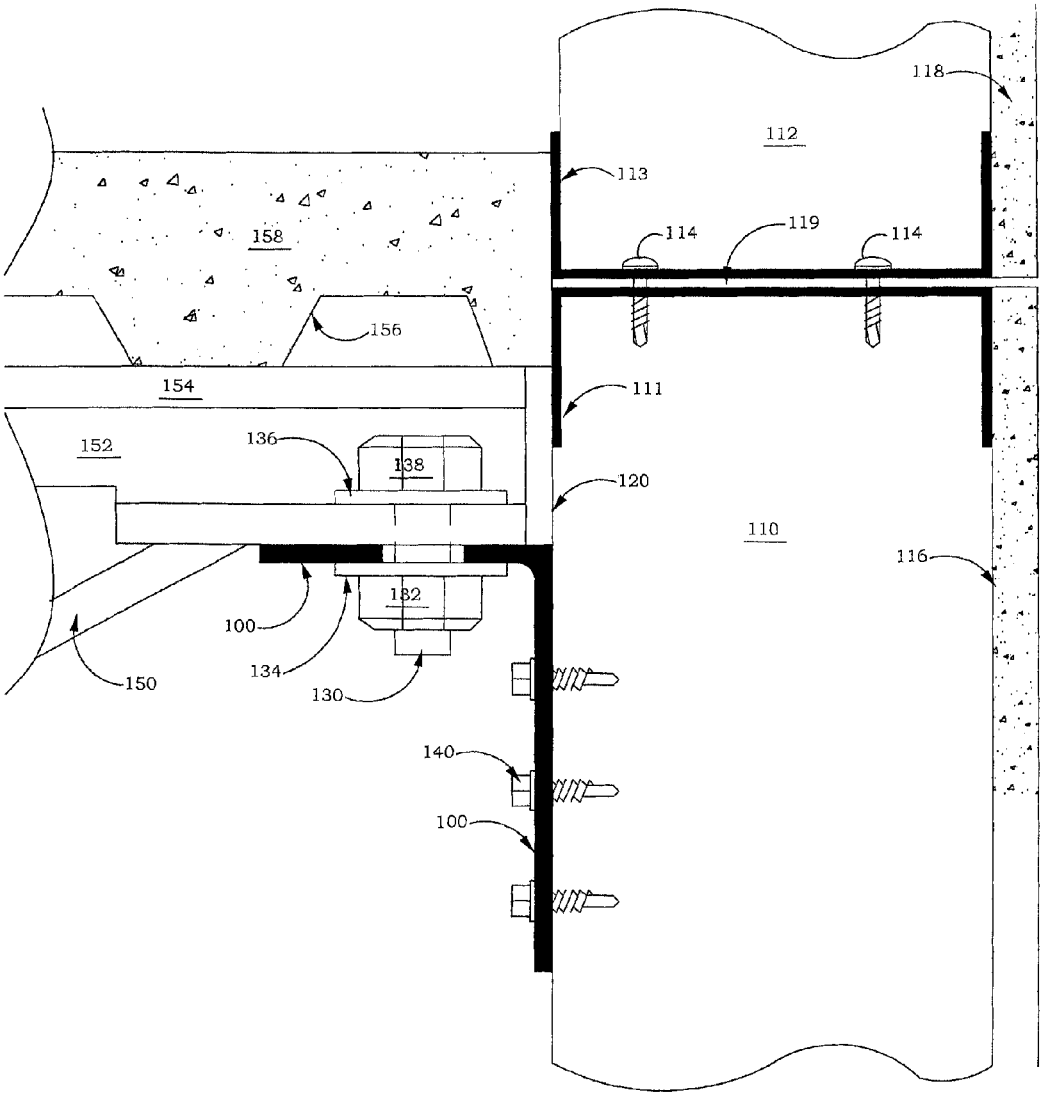
FIG. 21 is a cross-section of a joist support angle bracket installed on stud framing and securing a joist and decking assembly, also seen in cross-section.

Construction details for installation of a joist support angle bracket and related assemblies are shown in FIG. 21. Joist support angle bracket 100, shown in cross-section, is installed on lower wall stud framing member 110 and secured thereon by fasteners 140. The vertical portion of this bracket may be a 4 in by 5 in flange which attaches to the studs with six $5/16^{th}$ in screws. The horizontal joist ledger portion of the bracket can attach the joist seat with ½ in bolts which are 3½ in on-center. In this detail, joist members 150, 152 and 154 are shown in cross-section. The joist is secured to joist support angle bracket 100 by bolt 130 having bolt head 138, washers 134 and 136, and nut 132. A cross-section of corrugated decking 156 is shown atop joist portion 154. In this figure, concrete decking slab 158 has been poured atop deck sheathing 156.

In this construction, lower framing member 110 is capped with upper rail 111 shown in cross-section and supports upper framing member 112 and its associated lower rail 113. These framing members are preferably metal framing studs having conventional framing hardware. These upper and lower members are securely fastened, as by screws 114. In this figure, exaggerated seam 119 is shown only for clarity between the sections. In practice, the seam is eliminated when the upper and lower sections are secured together. Lower and upper sheathing panels 116 and 118 are depicted in cross section on the vertical wall panel opposite the joist. It will be understood that the concrete slab decking is poured up to the wall members, but not between them. Sheathing panels 116 and 118 may be gypsum board or other suitable panelized sheathing product.

Figure 22:
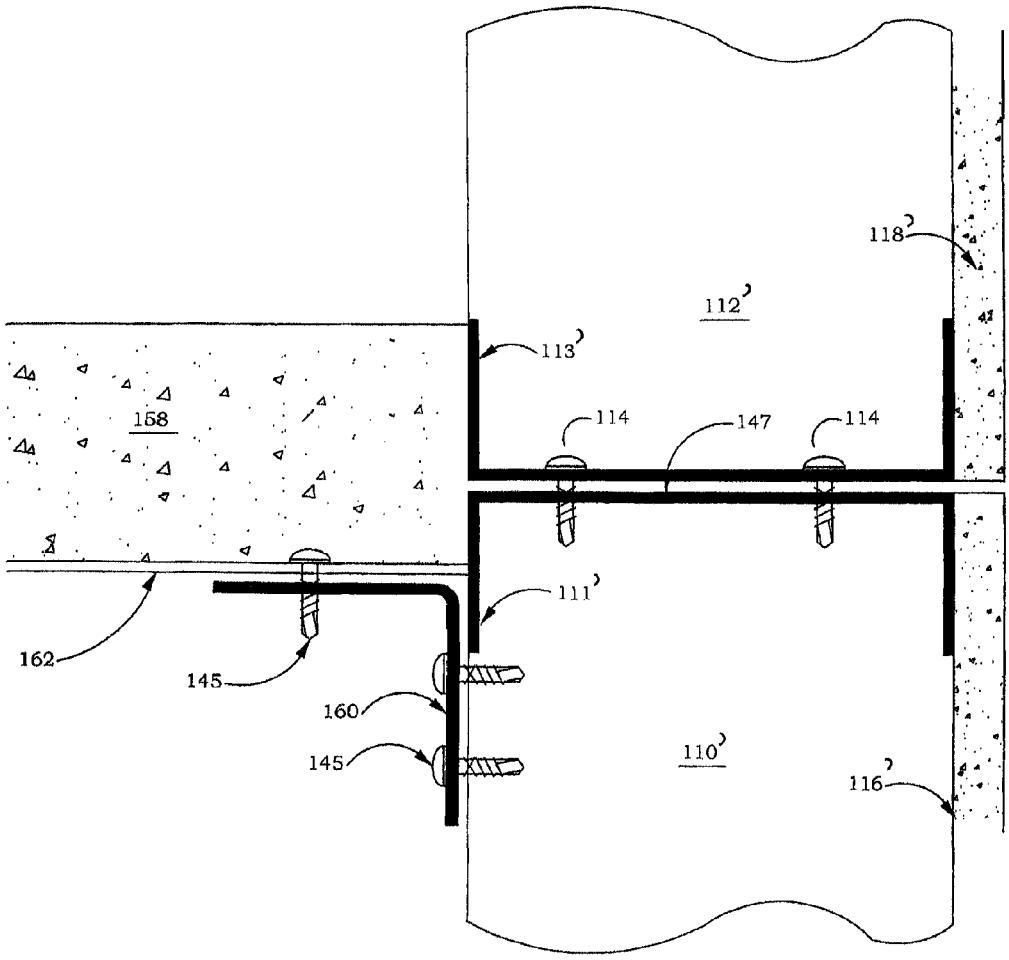
FIG. 22 is a cross-section of a decking support angle bracket installed on stud framing and securing a decking assembly, also seen in cross-section.

Construction details for installation of a deck support angle and related assemblies are shown in FIG. 22. Deck support angle 160, shown in cross-section, is installed on lower wall 110' and secured thereon by fasteners 145 which may be metal screws. In this detail, decking 162 is shown in cross-section. The suspended slab deck support angle is continuous conventional angle, e.g. 3 in by 3 in, trimmed to suitable lengths for ease of handling and effective for supporting the edge of the suspended decking and acting as a pour stop for the concrete floor. The decking is secured to deck support angle 160 by fastener 145. In this figure, concrete decking slab 158 has been poured atop deck sheathing 162. In this construction, as in FIG. 21, lower framing member 110' is capped with upper rail 111' shown in cross-section and which supports upper framing member 112' and its associated lower rail 113'. These upper and lower members are securely fastened, as by screws 114. In this figure, exaggerated seam 147 is shown only for clarity between the sections. In practice, the seam is tight and essentially eliminated as the upper and lower sections are secured together. Lower and upper sheathing panels 116' and 118' are here depicted in cross section on the vertical wall panel opposite the decking 162 and deck support bracket 160. In this embodiment, sheathing panels 116' and 118' are gypsum board. Once again it will be understood that the concrete slab decking is poured up to the wall members, but not between them as is the case in prior art constructions.

Figure 23:
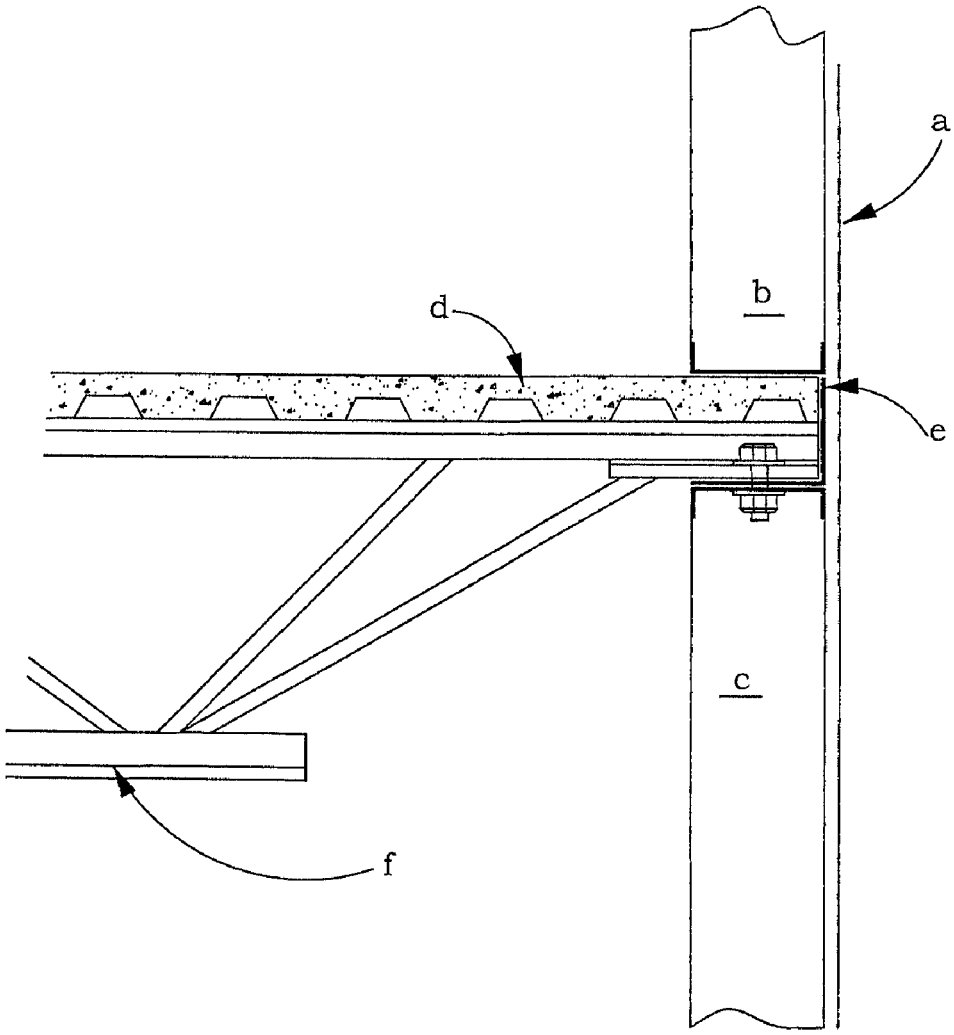
FIG. 23 is a cross-section depiction of prior art platform framing.

FIG. 23 is a cross-section of a prior art platform framing construction including exterior sheathing a, an upper load bearing wall b, a lower load bearing wall c, a concrete deck d, a joist hanger e, and a joist f. It is noteworthy that in such a construction, the poured slab floor d is located between the upper and lower load bearing walls b and c and therefore must be installed prior to construction of the upper walls. FIG. 23 shows that each concrete floor d must be poured and set prior to the formation of the next and, above, story. In stark contrast, the present invention permits all of the concrete floors to be poured at the same time, or as may be optimally desired.

The express framing system provides buildings comparable to those provided by other light gauge steel methods, such as the aforementioned platform framing technique. For example, such a building may have one or more load bearing quadrilaterals of about 100 ft by 100 ft. In such a building, an interior load bearing quadrilateral section might then be 50 ft by 100 ft. The typical height per story is 10 ft. The typical number of stories is 2 to 4, with 6 stories being the maximum for this type of light gauge steel mid-rise construction. Additionally, the joists run either lengthwise or widthwise, as the structure design dictates.

Specifications for construction members and hardware are typical of light gauge steel framing techniques. The preferred grades of steel vary with the parts and application. For example, the specification for joists, joist brackets, decking hangers, decking, support fixtures and other rolled structural steel shapes is ASTM A572. The specification for structural steel plates and items made from such plates is ASTM A36. The specification for structural steel tubes is A500 Gr. B. The specification for cold formed light gauge steel, used for the stiffened strapping, is ASTM A653 with yield strength of 33 ksi or 50 ksi, and galvanized to a G-60 coating as per ASTM C955. The specification for bolts, joints, fittings, etc. is ASTM A325 TC, with hardened nuts & washers. In typical applications, any grade or type of concrete slab would be suitable.

The invention claimed is:

1. A building sub-assembly including a lower set of vertically extending walls having a cantilever suspended slab joist support bracket affixed to and below an upper load bearing surface of said lower set of walls, an upper set of vertically extending walls, said upper set of walls resting on said cantilever bracket and lower set of walls, said cantilever bracket having a generally S-shaped cross-section with a horizontal upper portion configured to engage with the top of a load bearing wall member and be supported thereby, and a parallel lower portion configured to support a horizontal joist, the cantilever portion extending down and away from its corresponding load bearing lower wall panel, a horizontal joist extending from and having one end supported by said cantilever bracket portion, and a generally horizontal decking lying atop and supported by said joist, said horizontal decking lying upon a horizontal joist supported by the cantilever bracket supported by said lower set of load bearing walls carrying the joist load, whereby concrete poured on said decking forms a suspended slab concrete floor reaching up to but not between said upper and lower vertically extending walls and said suspended slab concrete floor is poured at any time after said joist and horizontal decking is affixed to and supported by a load bearing joist support wall positioned opposite said building sub-assembly.

2. The building sub-assembly of claim 1 wherein said cantilever suspended slab joist support bracket is placed upon and supported by the upper load bearing surface of said vertically extending load bearing walls.

3. The building sub-assembly of claim 1 wherein said cantilever bracket is a suspended slab joist support bracket placed upon and supported by the upper load bearing surface of said vertically extending load bearing walls.

4. The building sub-assembly of claim 1 wherein said cantilever bracket is a joist support angle bracket affixed to an upper location of a load bearing stud.

5. The building sub-assembly of claim 1 which additionally comprises a deck support assembly on walls perpendicular to said joist support walls, said deck support assembly utilizing a support bracket selected from the group consisting of suspended slab deck support brackets and angles, and configured for supporting a horizontal suspended slab concrete floor below the upper surface of said support bracket.

6. The building sub-assembly of claim 1 comprising a pair of said building sub-assemblies configured to support opposite ends of said horizontal joists and decking.

7. The building sub-assembly of claim 1 further comprising longitudinally stiffened strapping to reinforce construction members and minimize unintended movement of construction members.

8. The building sub-assembly of claim 1 further comprising a poured suspended slab concrete floor having a thickness determined by the placement of the suspended slab joist supporting bracket.

* * * * *